United States Patent [19]

Reinhold

[11] Patent Number: 4,905,511

[45] Date of Patent: Mar. 6, 1990

[54] FAN ASSEMBLY AND A METHOD FOR CHECKING THE FUNCTION THEREOF

[75] Inventor: Reinhold Pfaudler, Burtenbach, Fed. Rep. of Germany

[73] Assignee: AL-KO Polar GmbH Maschinenfabrik, Jettingen-Scheppach, Fed. Rep. of Germany

[21] Appl. No.: 267,125

[22] PCT Filed: Feb. 4, 1988

[86] PCT No.: PCT/EP88/00083

§ 371 Date: Sep. 23, 1988

§ 102(e) Date: Sep. 23, 1988

[87] PCT Pub. No.: WO88/05870

PCT Pub. Date: Jan. 11, 1988

[30] Foreign Application Priority Data

Feb. 5, 1987 [DE] Fed. Rep. of Germany ..... 3703401

[51] Int. Cl.[4] ..... G01F 1/00; G01M 19/00

[52] U.S. Cl. ..... 73/168; 73/196; 244/117 R

[58] Field of Search ..... 73/168, 861.61, 861.52, 73/723, 714, 198, 196; 98/1.5

[56] References Cited

U.S. PATENT DOCUMENTS

| | | | |
|---|---|---|---|
| 2,212,186 | 8/1940 | Ricardo et al. | 73/861.52 |
| 3,402,654 | 9/1968 | Berst | 98/1.5 |
| 3,733,900 | 5/1973 | De Baun | 73/168 X |
| 4,562,744 | 1/1986 | Hall et al. | 73/861.61 X |
| 4,638,233 | 1/1987 | Erdman | 73/168 X |

*Primary Examiner*—Daniel M. Yasich

*Attorney, Agent, or Firm*—Edwin D. Schindler

[57] ABSTRACT

In the context of a fan assembly for an air system comprising a bulkhead (20) and at least one fan (2) which extends through the bulkhead (20) and whose intake on the aspiration side and whose outlet on the pressure side are located in chambers (21 and 22) separated from each other by the said bulkhead (20), it is possible to obtain reproducible conditions for determining the volumetric performance if adjacent to the two sides of the bulkhead (20) there is in each case at least one pressure sensor (24 and 25) provided with a pressure gage connection (26 and 27).

14 Claims, 2 Drawing Sheets

FAN ASSEMBLY AND A METHOD FOR CHECKING THE FUNCTION THEREOF

The invention relates to a fan assembly for an air system with a bulkhead and at least one fan extending through the bulkhead, whose intake on the aspiration side and whose outlet on the pressure side are located in chambers separated from each other by the bulkhead. Furthermore, the invention is concerned with a method for checking the function of a fan assembly fitted as part of an air system, in which the volumetric performance of the fan is tested.

In an air system the problem frequently arises of an excessively low fan performance having been prescribed vowing to an erroneous conception of the plant so that during operation the desired air flow volumetric performance is not reached, something that may lead to malfunction. Since so far no precise method of measuring the actually achieved volumetric performance has become available for an installed air system, the blame for an existing malfunction is often incorrectly attributed.

In view of this, one object of the present invention is to devise simple means for precisely ascertaining the volumetric performance of a fitted air system and of the fan assembly installed therein.

As regards the equipment this object is achieved insofar as adjacent to both sides of the bulkhead there is at least one pressure sensor with a pressure gage connection.

With the aid of such a fitted pressure sensor it thus becomes possible to ascertain the absolute value of the pressure differential to be produced by the fan, that is to say of the fan in the already fitted condition. For this purpose the two sensors merely have to be connected via their pressure gage connection with a suitable pressure gage, something that is possible anywhere, that is to say quite feasible either on site or in testing equipment, this leading to an extreme simplification of functional testing of an air system. In test equipment the permanently fitted pressure sensors may be used in order to log characteristic curves, which on site make possible the ascertainment of the volumetric performance on the basis of the measured pressure differential. Owing to the pressure sensors' being permanently fitted it is possible to ensure that reproducible conditions are produced and that right from the start the marginal conditions for fitted state are automatically taken into account. Owing to the fact that measurement of pressure takes place directly at the bulkhead, it is possible to be certain that only the static pressure is sensed and dynamic components are left out of consideration, this being an advantage as regards the possible accuracy and the reproducibility. With the aid of the invention it is thus possible to exactly derive the precise value of the actual volumetric performance from the reading obtained with the pressure sensor on site and thus in the event of malfunction to obtain information as to whether for instance the trouble is due to an initial erroneous assessment of the requirement or an erroneous calculation. The same also applies to continuous monitoring.

The method aspect of the invention is characterized in that characteristic curves are determined for the complete fan assembly with the fitted fan, such curves respectively reflecting, for a given speed of rotation of the fan, the change in the differential between the pressures obtaining on the two sides of the bulkhead in relation to the volumetric displacement and in that the volumetric displacement is determined on the basis of such characteristic curves and the fan speed of rotation and also the pressure differential as measured on site on the bulkhead. The permanently fitted pressure sensors may be used both while ascertaining the characteristic curves and also when ascertaining the volumetric displacement on site as a means for taking readings so that the same marginal conditions obtain, this being a precondition for the reproducibility and accuracy strived at.

In addition to monitoring from time to time, the invention makes it possible, as has been already indicated, to perform continuous monitoring. For this purpose it is possible for the pressure gage arrangement, which is preferably permanently connected to the pressure gage connections of the pressure sensors, simply to be connected with a computer via its output terminal; the computer furthermore being supplied with the speed of rotation of the fan and the above mentioned characteristic curves preferably recorded on a data storage medium supplied along with the fan assembly of the invention. Continuous monitoring gives the advantage not only of a continuous indication of the current data but also the provision of an automatic alarm signal when limit values are exceeded or gone below. For instance by taking further readings for the current or power input of the drive motor and/or the speed of rotation of the fan it is then possible to very expediently analyse error conditions.

The pressure sensors may with advantage be fitted to the bulkhead so as to be opposite to each other. This results in a particularly simple structure.

In accordance with a further feature of the invention the pressure sensors are designed in the form of annular ducts, preferably in the form of pipes bent into an annular form, which extend around the periphery of the bulkhead, fit round the part of the fan extending through the bulkhead and are provided with a plurality of inputs. Such annular ducts are located on the intake and also on the pressure side reliably in the wind shadow so that despite the simplicity of the arrangement a high degree of accuracy is obtainable. At the same time the annular ducts with a plurality of inputs ensure compensation for local pressure differences.

A further advantageous feature of the invention is possible in which the pressure gage arrangement connected with the pressure sensors cooperates with a display device, which has a pointer moving in accordance with the pressure reading and at least one scale arranged on a carrier which is in the form of a separate component and may be moved into position, said scale being calibrated in accordance with the volumetric flow at an associated fan speed of rotation. These features provide for automatic indication of the volumetric flow. There is then the advantage that it is not necessary to employ manual coordinate systems with families of characteristic curves onto which the pressure readings then have to be transferred, this making for simpler handling and exact ascertainment of the volumetric flow, even if no computer is on hand.

Further advantageous developments and useful further outgrowths of the invention will be seen from the following account of one working example thereof in conjunction with the drawing and the dependent claims.

Figure 1:
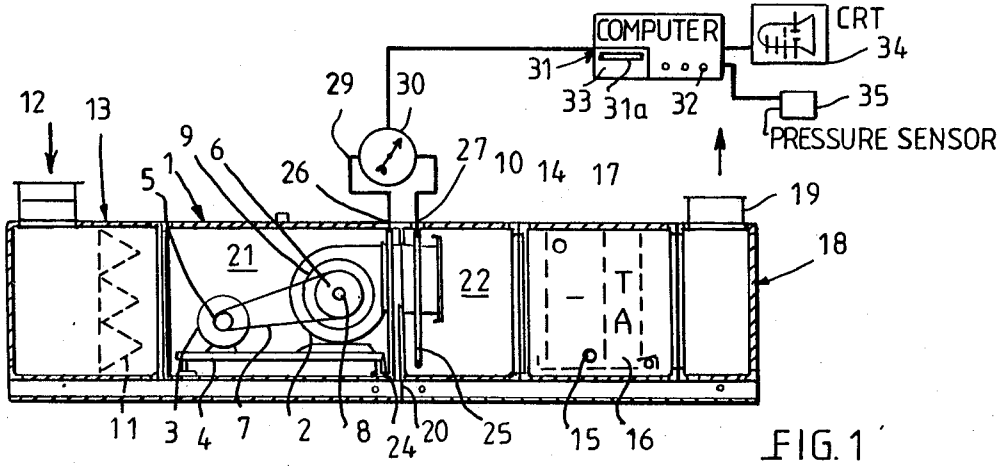
FIG. 1 is a diagrammatic longitudinal section taken through an air system in accordance with the invention.

The air system or air conditioning plant shown in FIG. 1 includes a number of modular units which are joined together. The structure and workings of such units are conventional. The central unit is in the present case a fan assembly 1, which comprises a fan 2 and the drive motor 3 associated therewith. The fan 2 and the drive motor 3 are mounted on a vibration damping stage 4 and are drivingly connected with each other by means of a belt 7 running over suitable pulleys 5 and 6. The diameter of the belt pulleys 5 and 6 accordingly determines the speed of rotation of the fan 2. The latter possesses a lateral intake pipe 9 arranged coaxially to the shaft 8 driven by means of the pulley 6 and an outlet pipe 10 extending tangentially out of the housing comprising the fan rotor, which is mounted on the shaft 8 and is not shown.

The fan assembly 1 is provided with an upstream filter member 13 having a filter 11 and an intake pipe 12. On the output side the fan assembly 1 furthermore has a cooling unit 17 with a bank of cooling pipes 15 and a condensate trap 16. The output side of the fan assembly 1 is also connected with an output part 18 with a delivery pipe 19. The individual components possess a support frame with an encircling casing. The end faces, which are in contact with each other, of the individual components are open in order to form a duct for flow of the air. It is only at the fan assembly 1 that there is a bulkhead 20 extending at a right angle to the axis of the flow in the duct, such bulkhead 20 so separating the intake pipe 9 and the outlet pipe 10 of the fan 2 that the open cross sections of the latter are in chambers separated from each other by the bulkhead 20. The input cross section of the intake pipe 9 is located in the chamber 21 arranged in front of the bulkhead 20 and formed by the inner space of the fan assembly 1. The outlet of the pressure pipe 10 is located in the chamber 22 defined by the inner space of the empty part 14.

The bulkhead 20 is constituted by a piece of sheet metal flanged onto the support frame of the fan assembly 1 at the downstream side thereof. The pressure pipe 10 of the fan 2 is flange mounted on the sheet metal part. As will be best seen from FIG. 2, the bulkhead 20 is made with a recess 23 accommodating the pressure pipe 10 in a sealing manner so that the chambers 21 and 22 are only connected with each other by way of the working space of the fan 2 accommodating the fan impeller which is not shown in detail. The pressure pipe 10 may come to an end at the bulkhead 20 or, as in the illustrated working example of FIG. 1, extend into the chamber 22 of the empty part 14. The chamber supplied by the pressure pipe 22 of the empty part serves as a manifold chamber for the supply of the cooling part 17, such manifold chamber ensuring an even supply of air to the entire bank of cooling pipes across the full cross section.

Figure 2:
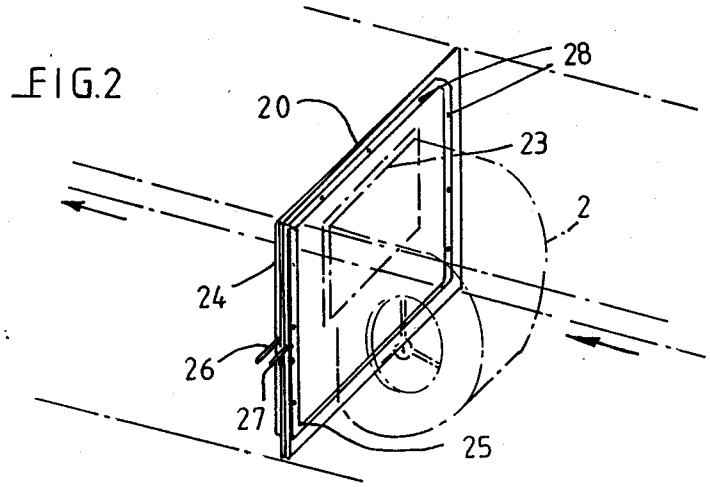
FIG. 2 is a diagrammatic representation of the bulkhead with the associated pressure sensors.

As will furthermore be seen from FIGS. 1 and 2, on the two sides of the bulkhead 20 there are pressure sensors 24 and, respectively, 25 fitted around the pressure pipe 10 extending through the bulkhead 20, such sensors each having a connection pipe 26, and, respectively 27, which extend through the outer casing of the fan assembly 1 and, respectively, of the empty part 14 and are designed for use with a pressure gage arrangement of the type indicated in FIG. 1 at 30. The pressure sensors 24 and 25 are in the present case simply in the form of pipes bent into an annular shape so as to run round the periphery of the bulkhead 20, such pipes having a plurality of inputs 28 in the form of drilled holes in the pipe wall which are evenly distributed around the periphery of the bulkhead 20. The diameter of the drilled hoes forming the inputs 28 is equal to between 1/4 and 1/2 of the clearance diameter of the pipes forming the pressure sensors. The curved pieces of pipe forming the pressure sensors 24 and 25 may be directly attached to the bulkhead by means of pipe cleats or the like and not shown in detail. The connection pipes 26 and 27, respectively, are in the form of connecting pipes placed radially with respect to the axis of the curved pieces of pipes, such connection pipes extending through the outer casing of the fan part 1 and the empty part 14, respectively, and are able to be connected by means of a piece of flexible hose 29 slipped onto them with the pressure gage 30.

The pressure sensors 24 and 25 with the associated connection pipes 26 and 27 are permanently installed so that a pressure gage 30 may be connected whereever desired by slipping the ends of the connections hose 29 onto the permanently connected pipes 26 and 27. With the aid of the pressure gage 30 connected in the manner shown in FIG. 1, it is possible to obtain a reading for the pressure differential between the intake side and the pressure or delivery side of the fan fitted in the fan assembly 1. The pressure sensors 24 and 25 fitted to the bulkhead 20 are in the wind shadow both on the pressure and on the intake sides so that there are no dynamic effects on the pressure gage 30 and readings are only given for the static pressure.

Figure 3:
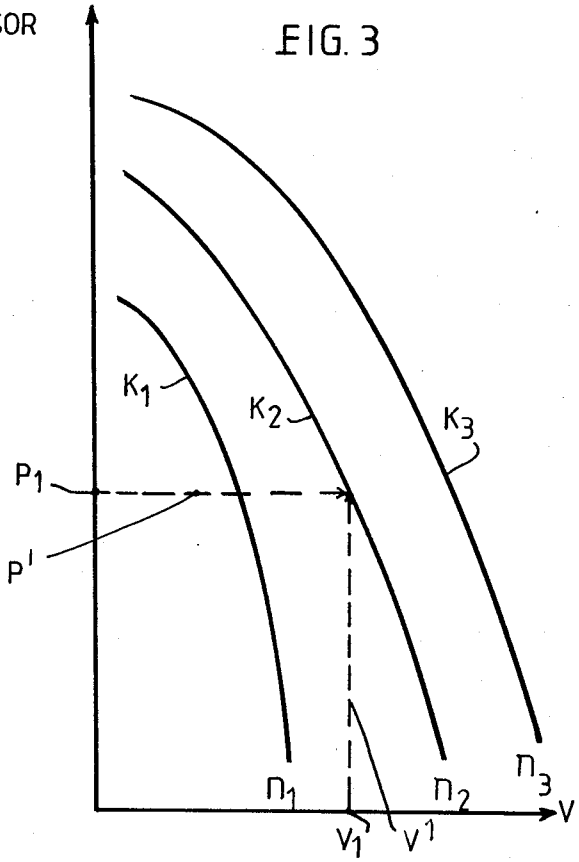
FIG. 3 shows a family of characteristic curves for the arrangement of FIG. 1.

In order to increase the volumetric performance of an air system generally of the type shown in figure using the pressure differential as detected by the pressure sensors 24 and 25, the first step is to establish characteristic curves, which as shown in FIG. 3, each indicate the volumetric performance as a function of the said pressure differential for a given speed of rotation of the fan, that is to say for a given pair belt pulleys. In the family of characteristic curves shown in FIG. 3 the pressure differential is indicated by the vertical axis and the volumetric performance by the horizontal one. For the fan speeds of rotation $n_1$, $n_2$ and $n_3$ there are the characteristic curves $K_1$, $K_2$ and $K_3$. For establishing the characteristic curves $K_1$, $K_2$ and $K_3$, respectively, the pressure differential determined with the pressure sensors 24 and 25 is articially varied with the aid of fitted louvers or the like. A reading is taken for the volumetric performance for each pressure differential set. The readings are plotted on the graph of FIG. 3 and connected to produce the family of curves $K_1$, $K_2$ and $K_3$.

The characteristic curves of the type indicated at $K_1$, $K_2$ and $K_3$ are established on a test bed, more or less only the fan assembly 1 and the empty part 14 containing the second pressure sensor 25 being needed. As soon as the characteristic curves have been established the volumetric performance may be readily determined for each fan assembly of the same type whatever air system it is to be installed in. For this purpose the pressure differential is measured on site on the upstream and downstream sides of the bulkhead 20, this being simply possible by the connection of a pressure gage 30 in the manner indicated in FIG. 1 with the permanently installed connection pipes 26 and 27 of the permanently installed pressure sensors 24 and 25. With the aid of the pressure differential as so established and on the basis of the fan speed in question, that is to say the characteristic curve $K_1$, $K_2$ and $K_3$ it is then possible to determine the volumetric performance, as will be seen from the auxiliary lines P' and V', respectively, as plotted in FIG. 3. In a given case the fan 2 is to run at the speed of rotation $n_2$. The pressure differential $P_1$ measured by the pressure sensors 24 and 25 is then linked to the volumetric performance $V_1$.

The pressure gage arrangement 30 may include two separate pressure gages. In the illustrated example of the invention it is a question of an oblique tube pressure gage, which automatically gives the absolute value of the pressure differential. The same would be case with a U-tube pressure gage for instance. The two pressure gages 24 and 25 arranged opposite each other with respect to the bulkhead 20 may have the same configuration and dimensions, this making rational manufacture possible.

In the case of ad hoc monitoring of the volumetric performance it is sufficient if the pressure gage arrangement 30 has a scale. The reading taken from the scale may then be plotted on a family of characteristic curves as in FIG. 3. In the case of the form of the invention shown in FIG. 3 one signal output of the pressure gage arrangement 30 with sensor 35 is connected with the input of a computer 31. In the illustrated working example the signal output of the pressure gage arrangement 30 is a digital signal output. In the case of an analog output it would be necessary to connect an A/D transducer between it and the computer. The computer 31 may also be supplied with the speed of rotation of the fan 2 as well. For this purpose the speed of rotation may be measured and recorded directly. In the illustrated working example the speed of rotation is set by means of control knobs indicated at 32. The computer 31 is provided with a memory 33 which holds the characteristic curves of FIG. 3 in a digitalized form, and such characteristic curves may for instance be loaded from a diskette or 31a or other data medium supplied with the fan assembly 1 and used in the computer at 33. Furthermore characteristic curve families of the type indicated in FIG. 3 are also supplied for ad hoc monitoring.

One output of the computer 32 is connected with one output of a display, in the present case in the form of a CRT 34, on which the current volumetric flow data may be continuously inspected, such data for instance being in the form of numbers, curves or bar diagrams or the like. A further output of the computer 31 is connected with an alarm device for operation thereof if limit values should be exceeded or gone below.

In the working example shown speed of rotation is permanently set. However, it would also be possible to still further improve the analysis of errors by extending the data read to cover the speed of rotation of the fan 2 or the power intake of the drive motor 3 and the like.

Figure 4:
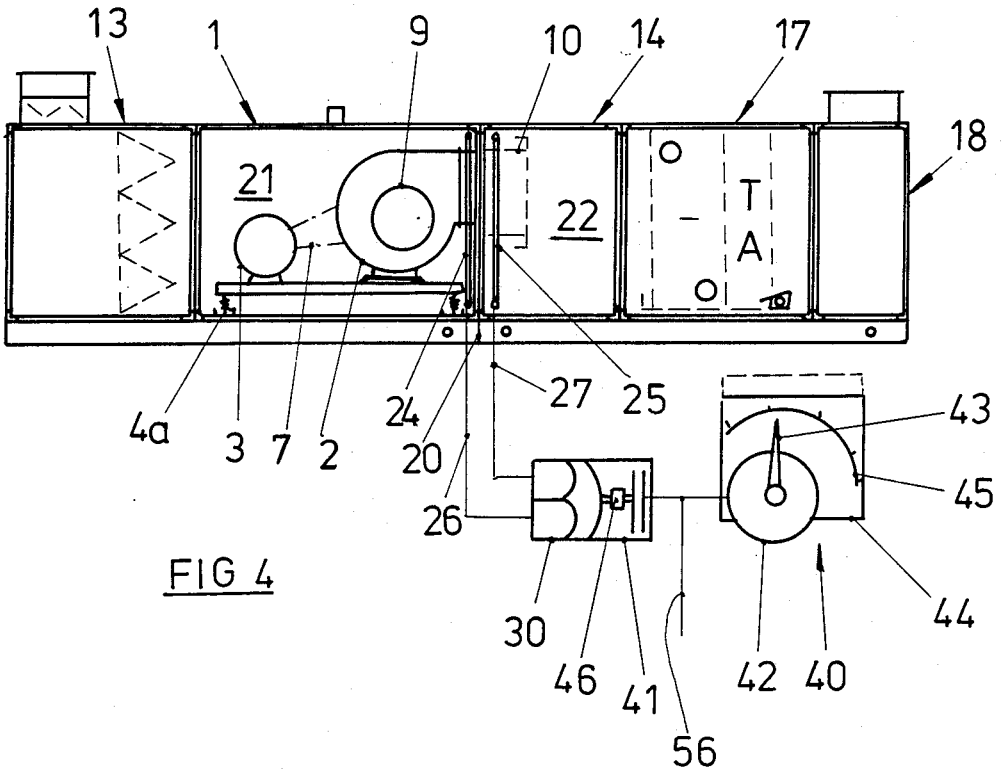
FIG. 4 shows an example with an indicating device in a view corresponding to FIG. 1.
Figure 5:
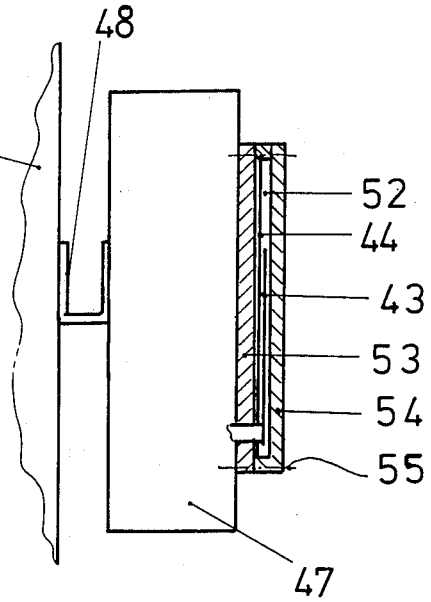
FIG. 5 is a view of part of the housing for the indicating device.

The arrangement shown in FIG. 4 facilitates operation when no computer is available on site. The basic structure of the arrangement of FIG. 4 is the same as that of the arrangement of FIG. 1. Accordingly like references denote like parts.

In order not to require a manual transfer of the pressure differential readings from the pressure gage arrangement 30 to a family of characteristic curves as in FIG. 3, in the arrangement of FIG. 4 the pressure gage arrangement 40 connected with the pressure sensors 24 and 25 is also connected with a display device 40, which has a pointer 43 moving to show the pressure differential reading and a scale carrier 44, which in the present case is in the form of separate component which may be moved into position and which carries the scale calibrated as the speed of fan rotation. From the scale it is then possible to get a reading for the volumetric flow as indicated by the pointer 43 on the scale 45 on site.

The characteristic curve of the family of characteristic curves of FIG. 3 applying for the fan speed of rotation on site is marked on the scale 45, which may be established with the aid of simple program and printed on the scale carrier 44. The scale carrier 44 includes a sheet of cardboard or the like, which is put in the correct position in relation to the pointer 43 so that it may be readily replaced and if the fan speed of rotation should change it then only necessary to put in a new scale carrier with a suitably adapted scale. It would naturally be possible to have a number of different scales for different respective speeds of rotation on the same scale carrier 44. In any event the simple manner of putting the scale in position as a separate component makes possible simple production, since for the individual adaptation of the display device 40 of suit specific conditions of any sort of air system only means that a new scale carrier with a suitably adapted scale is needed. Since on site the fan speed of rotation is not changed, the replaceable scale carrier 44 may be made tamper-proof with a lead tamper-proof seal in the housing of the display device containing it.

In the illustrated working example of the invention the pressure gage arrangement 30 has its output connected with a pressure-voltage transducer 41, whose output is connected with the input of a voltmeter 42, whose pointer forms the pointer 43 of the display device 40. The use of a voltmeter as part of the display device 30 leads to a simple design. In order to ensure full utilization of the maximum possible inflection of the pointer 43 in each individual case the pressure gage arrangement 30 and/or the transducer 41 are provided with means 46 for setting the range swept and the null point. 56 indicates a further output in the form of an analog and/or digital output which may be connected with data processing equipment.

Together with the pressure gage arrangement 30 and the transducer 41 the display device is accommodated in a housing 47, which, as will be seen from FIG. 4, is able to be mounted on the housing of the fan assembly 1 using a U-like support cleat 48 with a clearance between it and the wall, this providing isolation from vibrations. In order to provide further protection against the transmission of vibrations to the display device 40 it may in addition be expedient to mount the stage on which the fan 2 and the drive motor 3 are placed on resilient shock absorbers 4*a*.

On its front side the housing 47 is provided with a window, which has a plug-in opening 52, into which the pointer 43 extends and into which the replaceable and possibly sealed scale carrier 44 may be so inserted that it has the pointer 43 fitting over it. The illustrated working example of the invention the window includes a base plate 47 attached to the housing 47 and a cover 54 which may be fitted thereover and which has the form of a trough. The cover 54 is secured in place by means of retainer screws 55, which may be also sealed to prevent tampering. It would naturally also be possible for the recess 52 to be associated with an insertion slot via which the scale carrier 44 might simply be inserted. The design illustrated is however completely dust-proof. In order to hold any scale carrier which are not inserted and/or conversion tables etc., the housing 47 may be provided with a compartment, not shown in detail, outside the cover 53 and 54.

I claim:

1. A fan assembly having a fan component for a space ventilating unit, comprising:

a bulkhead;

at least one fan passing through said bulkhead, said fan having an inlet on a suction side and an outlet on a pressure side, said inlet and said outlet being located in separate chambers which are separated from each other by said bulkhead; and, a plurality of pressure sensors with at least one pressure sensor being located on each side of said bulkhead, each of said pressure sensors being provided with a manometer connection in which at least one of said pressure sensors on each side of said bulkhead is constructed as an annular duct which encircles the periphery of said bulkhead and embraces an area where said fan passes through said bulkhead, said annular duct of each of said pressure sensors being provided with a plurality of inlets.

2. The fan assembly according to claim 1, wherein two of said plurality of pressure sensors are attached to said bulkhead so as to be positioned opposite one another.

3. The fan assembly according to claim 1, wherein said plurality of inlets of said annular duct of each of said pressure sensors have a diameter of 1–3 mm.

4. The fan assembly according to claim 1, wherein said plurality of pressure sensors are in a tubular form bent into an annullar form, which are each provided with a plurality of peripheral holes and have connecting pipe as said manometer connection which extends out of a housing which accomodates said bulkhead.

5. The fan assembly according to claim 1, wherein said pressure sensors, located on each side of said bulkhead, have the same construction.

6. The fan assembly according to claim 1, further comprising a pressure gage arrangement which is connected to said plurality of pressure sensors, said pressure gage arrangement having an output which is connected with a first input of a computer, said computer having a second input for the speed of rotation of said fan and a memory device for pressure/volume characteristic curves, said memory device of said computer being capable of being loaded via a data storage medium.

7. The fan assembly according to claim 6, wherein said computer is connected with a display device and an alarm device.

8. The fan assembly according to claim 7, wherein said display device is a CRT.

9. The fan assembly according to claim 6, wherein said data storage medium is in the form of a diskette.

10. The fan assembly according to claim 1, further comprising a pressure gage arrangement which is connected to said plurality of pressure sensors, said pressure gage arrangement cooperates with a display device, which includes a pointer which is capable of being moved in accordance with a measured pressure differential, and at least one scale carrier in the form of a separate component and able to be moved into position, said scale carrier having a scale which is calibrated with a volumetric flow at an associated fan speed of rotation.

11. The fan assembly according to claim 10, wherein said pointer is a pointer of a voltmeter, which is connected by means of a pressure-voltage transducer with said pressure gage arrangement, said pressure gage arrangement or said transducer having a setting for varying the range of measurement.

12. The fan assembly according to claim 10, wherein said scale carrier is able to be secured to a housing for said display device so that it is capable of being replaced.

13. The fan assembly according to claim 12, wherein said housing for said display device is mounted by means of at least one U-like cleat on a housing of said fan assembly with a clearance from a wall, said fan being mounted with a drive motor on vibration damping elements.

14. A process for checking the functioning of a fan assembly by a determination of air flow volumetric performance, said fan assembly having a fan component for a space ventilating unit, which includes:

a bulkhead;

at least one fan passing through said bulkhead, said fan having an inlet on a suction side and an outlet on a pressure side, said inlet and said outlet being located in separate chambers which are separated from each other by said bulkhead; and, a plurality of pressure sensors with at least one pressure sensor being located on each side of said bulkhead, each of said pressure sensors being provided with a manometer connection, said process comprising the steps of:

establishing a series of characteristic curves and scales wherein air flow volumetric performance is plotted as a function of pressure differential for a given fan speed of rotation, said pressure differential being the difference in pressure on each side of said bulkhead in relation to a delivered volume;

on-site measuring of the pressure differential on an upstream side and a downstream side of said bulkhead;

on-site measuring of the fan speed of rotation; and, determining the air flow volumetric performance on the basis of the on-site measurement of the pressure differential by linking the on-site measured pressure differential to a particular air flow volumetric performance on the basis of the characteristic curve utilized for a given fan speed of rotation.

* * * * *